United States Patent [19]

Valenzona

[11] Patent Number: 4,777,333

[45] Date of Patent: Oct. 11, 1988

[54] ROCKER SWITCH

[75] Inventor: Joseph F. Valenzona, La Mirada, Calif.

[73] Assignee: Judco Manufacturing Company, Harbor City, Calif.

[21] Appl. No.: 75,525

[22] Filed: Jul. 20, 1987

[51] Int. Cl.[4] ..... H01H 21/40

[52] U.S. Cl. ..... 200/68.1; 200/339

[58] Field of Search ..... 200/339, 68.3, 68.1

[56] References Cited

U.S. PATENT DOCUMENTS

| | | | |
|---|---|---|---|
| 3,227,820 | 1/1966 | Sorenson | 200/339 |
| 4,147,908 | 4/1979 | Swann | 200/68.3 |
| 4,170,725 | 10/1979 | Farrell | 200/68.3 |
| 4,418,254 | 11/1983 | Busby et al. | 200/68.3 |

FOREIGN PATENT DOCUMENTS

| | | | |
|---|---|---|---|
| 2847772 | 5/1979 | Fed. Rep. of Germany | 200/68.1 |
| 22402 | of 1896 | United Kingdom | 200/68.1 |
| 504053 | 4/1939 | United Kingdom | 200/68.1 |

*Primary Examiner*—Renee S. Luebke

*Attorney, Agent, or Firm*—Fulwider, Patton, Rieber, Lee & Utecht

[57] ABSTRACT

A rocker switch incorporating a sliding contact that provides both the detent action and high current capacity desirable in such switches. The sliding contact is in the shape of a shoe with an essentially inverted wedge shape in which the angle of the wedge is an obtuse angle with its apex pointed away from the rocker. The sliding of this shoe-like contact across electrical contacts in the bottom of the switch creates the switching action.

5 Claims, 1 Drawing Sheet

FIG. 1
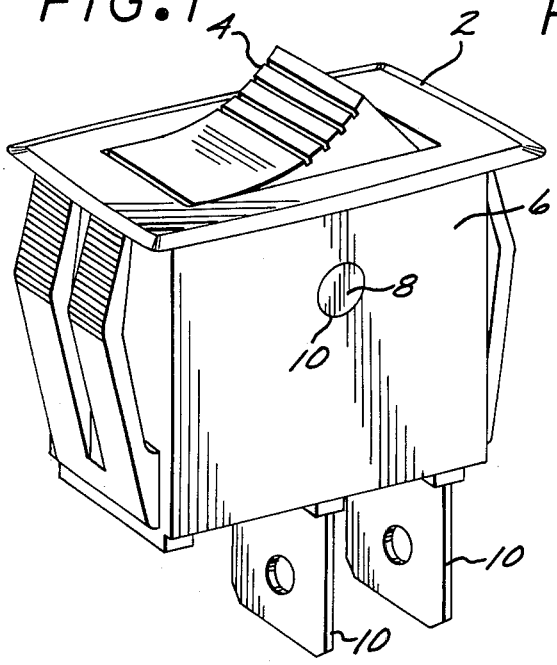
FIG. 3
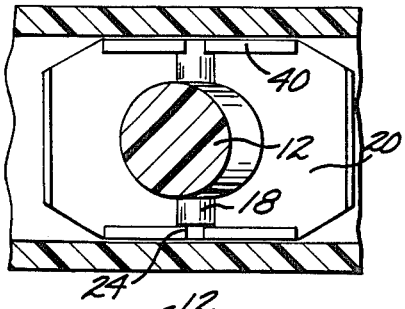
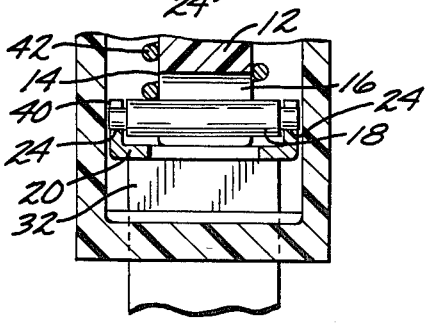
FIG. 4
FIG. 2
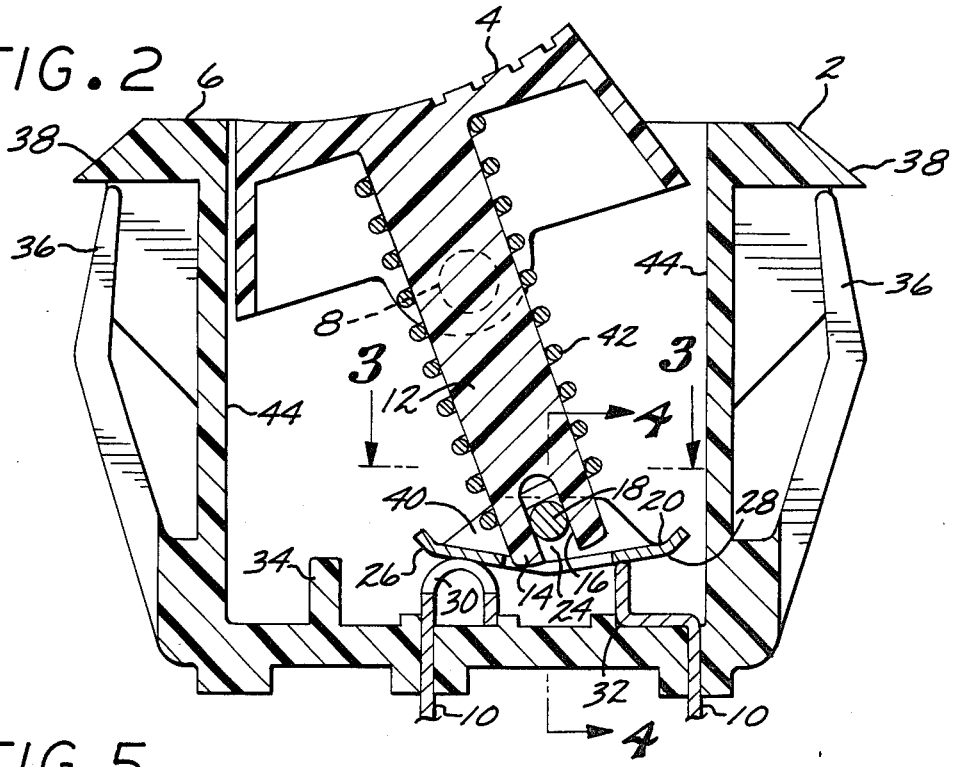
FIG. 5
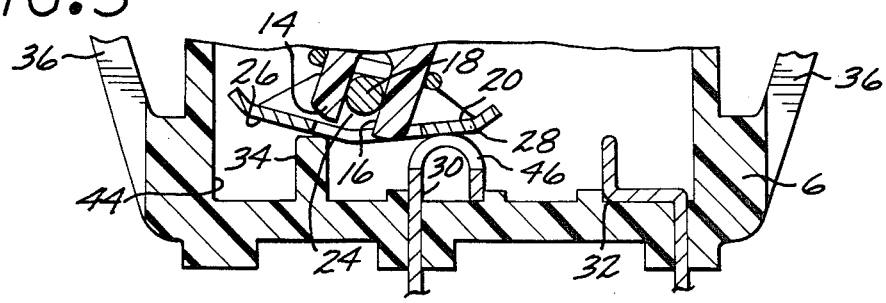

ROCKER SWITCH

BACKGROUND OF THE INVENTION

This invention relates to the field of electrical switches and, more specifically, to switch constructions useful for rocker switches. Rocker switches are commonly used to provide low profile switch assemblies for applications in which single or multiple pole, single or multiple throw switches are used. Such switches have generally been constructed of assemblies that provide detent mechanisms operating a conventional switch of either the massive contact or snap-action miniature variety. The snap-action miniature switch, while useful for a variety of these applications, is relatively expensive and complex; the massive contact switch, while simple and robust, is subject to arcing and other transient electrical phenomena associated with the configuration of the terminals and with the mechanism of making and breaking the circuits. Furthermore, such switches have been prone to erosion of the contacts in high current applications and have generally exhibited high wear unless relatively massive contacts or noble metals are used in the construction of the contacts. There remains, therefore, a need for a construction which minimizes the transient wear and erosion associated with high currents applied to rocker type switch constructions.

SUMMARY OF THE INVENTION

The present invention was conceived to provide a solution to the problems inherent in previously available rocker switch constructions. These problems included complexity of construction and difficulties in the ability to handle high current loads during the switching operation. A major object of the invention was to provide such advantages in a relatively simple and robust construction that was easily applicable to a variety of switch configurations, thereby simplifying and economizing the construction of switches.for a wide variety of applications. The present invention, rather than utilizing the previous concepts involving massive or noble metal terminals or snap-action miniature switches, incorporates a sliding shoe-like contact that smoothly, reliably and efficiently accomplishes electrical contact between stationary contacts in the body of the switch, thereby minimizing the transients associated with switching and also providing a relatively large surface through which current may be transmitted. The large surface available by the use of this shoe-like contact has a further advantage in that relatively high spring rates may be used to force the shoe-like contact onto the stationary contacts, thereby improving the conduction of current across the contacts without unnecessarily increasing the wear on the switch components.

The shoe-like contact is moved by a fork and blade assembly connected to the rocker actuation system and the desirable detent action associated with such switches is provided by the configuration of the shoe-like contact and the contacts upon which it slides. By configuring the shoe-like contact in a wedge shape with the apex pointed downward, away from the fork and blade assembly, a positive detent action is generated as the contact is moved across the stationary contacts in the switch body. By use of this configuration, the requirement for a separate detent mechanism is eliminated and the switch is thereby substantially simplified to the benefit of its manufacturability, cost and maintenance.

The switch may be configured such that various portions of travel of the shoe-like contact can be over either conductive or nonconductive terminals, thereby varying the action of the switch and the switching functions. The width of the shoe-like contact may be altered to easily and inexpensively provide for increased current carrying capacity for a given switch action.

Thus, the present invention overcomes many of the limitations of previously available switches and provides these advantages in a simple, inexpensive, easily manufacturable apparatus. Other objects and features of the invention will become apparent from consideration of the following description taken in connection with the accompanying drawing.

BRIEF DESCRIPTION OF THE DRAWINGS

FIG. 1 is an overall perspective view of a switch incorporating the invention, illustrating a preferred embodiment of the rocker and external terminal arrangement.

FIG. 2 is a cross section of a switch incorporating the invention, illustrating the arrangement of the components of a single pole, single throw version of the switch with the switch in the closed position.

FIG. 3 is a view of the invention from section 3—3 of FIG. 2, illustrating the plan form of the sliding shoe-like contact of the invention.

FIG. 4 is a view at 4—4 of FIG. 2, showing an end view of the sliding shoe-like contact and stationary contacts in the switch assembly.

FIG. 5 is a cross section at the same section as FIG. 2, illustrating the switch in the open circuit position.

DESCRIPTION OF THE PREFERRED EMBODIMENT

Rocker switches provide many functional advantages for a variety of applications due to the low profile of the actuation mechanism, the compactness of the switch assembly and their adapability to a variety of installations. However, many forms of such switches have suffered from either unnecessary complexity, poor current carrying capacity, expense of manufacture or a combination of these deficiencies. The present invention overcomes these limitations in the previous switch concepts by employing a sliding shoe-like contact that is operated directly by a member connected to the rocker, thereby directly providing the detent action desirable for such a switch via the configuration of the sliding shoe and the terminals over which it passes. The present invention elegantly combines a solution to two problems: the detent mechanism and reliable operation with high current loads. This solution is achieved by the use of a uniquely configured sliding shoe-like contact mechanism. The figures discussed below illustrate, by way of example, the features and benefits of the present invention.

FIG. 1 is an illustration of an external view of a rocker switch according to the present invention, showing a perspective view of the rocker switch mechanism 2. Rocker 4 includes an actuable portion located exteriorly of the housing 6, the remainder of the rocker being mounted in the housing 6 for pivotal movement about the transverse axis of a pivot pin 8, which is mounted in a bore in housing 6. External terminals 10 connected to internal contacts (not shown) are used to connect the contacts in the switch mechanism to an external circuit. The switch mechanism may be mounted in any of a number of ways, including panel mounting by the use of snap retention mechanisms or fasteners.

FIG. 2 illustrates a cross section of a rocker switch constructed according to a preferred implimentation of the invention. In this preferred embodiment, operator rocket 4 pivots about a transverse axis upon pivot pin 8 in a bore in housing 6. Rocker 4 has an integral shaft portion or shaft 12 that extends downward from the external rocker surface and includes a clevis 14 at its free end. Clevis 14 incorporates a slot 16 in which a load distribution or pivot pin 18 is free to move. Shoe-like contact 20 is rotatably mounted on pin 18 by means of a journal 24 integrally formed in shoe-like sliding contact 20. Adjacent contact ramps or surfaces 26 and 28 of shoe-like contact 20 are formed to provide the detent action desired of the switch as it is moved by shaft 12 from contact with central or common contact 30 into engagement with either end contact 32 or nonconductive end contact 34 illustrated in position in the housing base of this single pole, single throw switch. In the configuration illustrated, shoe-like contact 20 is configured with an a shallow v or obtuse wedge shaped surface made up of surfaces 26 and 28, with the control cam portion or apex of the wedge pointed downwards. The angle of this wedge may be altered to provide relatively strong or weak detent action as the apex of the wedge rests between adjacent contacts. For example, a relatively shallow wedge angle will have a weaker detent action, while a deeper wedge angle will have a relatively stronger detent action. If nonconductive contact 34 were altered to be conductive, the switch could be a single pole, double throw switch. FIG. 2 illustrates a typical slide-in mounting system comprising ears 36 that are molded into body 6 of the switch and which combine with shoulders 38 to allow easy insertion and retention of the switch. Shoulder 40 is formed in shoe-like contact 20 in order to provide a lateral locating surface for contact 20 in housing 6. A compression spring 42 is used to urge contact 20 towards contacts 30 and 32 by forcing contact 20 axially away from the shaft 12 when shaft 12 reaches the limits of its desired travel. Up turned shoulders 46 serve to provide smooth transition of contact 20 across contacts 30, 32 and 34 and also prevent increasing wear when they come in contact with internal surface 44.

FIG. 3 illustrates a plan form of sliding shoe-like contact 20 as viewed from 3—3 of FIG. 2, and illustrates how pin 18 is mounted through shaft 12 and into journals 24 in shoe-like contact 20. Journals 24 may be formed in up turned side portions or shoulders 40 formed in shoe-like contact 20. Journals 24 may then be bored through each shoulder to provide for mounting of pin 18. Alignment of the shoe-like contact 20 is provided by the close fit of housing 6 on each side of the shoulders 40 of shoe-like contact 20.

FIG. 4 is a cross section at 4—4 of FIG. 2 and illustrates the arrangement of the sliding shoe-like contact 20 in slot 16 of clevis 14. As noted above, pin 18 is mounted through journals 24 bored in shoulders 40 and sliding contact is maintained with terminal 32 until the shoe passes over center and snaps into positive contact with terminal 30 and nonconductive contact 34. The wedge shape of the shoe-like contact in the preferred embodiment both rotates and slides as it crosses from one contact to the other, since the combination of the two surfaces of the wedge and the stationary contact configuration will cause a rotation first in a clockwise direction and then in a counter-clockwise direction as the shoe-like contact is moved across a terminal from right to left in the illustration.

FIG. 5 illustrates a partial cross section similar to FIG. 2 in which sliding shoe-like contact 20 has been moved from the closed to the open position on the single pole, single throw switch assembly. Clevis 14 incorporates a slot 16 in which a pin 18 is free to move. Shoe-like contact 20 is rotatably mounted on pin 18 by means of a journal intergrally 24 formed in shoe-like contact 20. Adjacent contact surfaces 26 and 28 of shoe-like contact 20 are formed to provide the detent action desired of the switch as it is moved by shaft 12 from contact with common contact 30 into engagement with either contact 32 or nonconductive contact 34 illustrated in this single pole, single throw switch.

As discussed above, shoe-like contact 20 is configured with an obtuse wedge shaped surface made up of surfaces 26 and 28, with the apex of the wedge pointed downwards. The angle of this wedge may be altered to provide relatively strong or weak detent action as the apex of the wedge rests between adjacent contacts and a relatively shallow wedge angle will have a weaker detent action, while a deeper wedge angle will have a relatively stronger detent action. If nonconductive contact 34 were altered to be conductive, the switch could be a single pole, double throw switch. Shoulder 40 is formed in shoe-like contact 20 in order to provide a lateral locating surface for contact 20 in housing 6. Spring 42 is used to urge contact 20 towards contacts 30 and 32 by forcing contact 20 axially away from the shaft 12 when the shaft 12 reaches the limits of its desired travel. Up turned shoulders 46 define curvilinear portions to provide smooth transition of contact 20 across contacts 30, 32 and 34 and also prevent increasing wear when they come in contact with internal surface 44.

In this figure, it can be seen that the contours of sliding shoe-like contact 20 are holding rocker 4 in positive displacement away from conductive terminal 32. In each case, an additional stop for the travel of the rocker mechanism is provided by the internal surface 44 of switch body 6. In the embodiment illustrated, contact 30 has a loop 46 formed in its free end in order to reduce the friction and abrasion that might otherwise occur if contact 30 were to have an unfinished end. Loop 46 also serves to control the detent actions caused when sliding contact 20*a* travels across contact 30, and the radius of loop 46 may be chosen to provide a desired detent action as sliding contact 20 travels across contact 30.

From the above description, it can be seen that the unique combination of component configurations of the present invention provides a simple, easily manufacturable and reliable rocker switch with positive detent action. The switch construction of the present invention also provides reliable operation with high current loads and maximizes the surface contact between stationary and sliding terminal to provide a massive and relatively large surface area contact to dissipate heat created as the result of current flow during steady state conditions.

While a particular form of the invention has been illustrated and described, it will also be apparent to those skilled in the art that various modifications can be made without departing from the spirit and scope of the invention. Accordingly, it is not intended that the invention be limited except as by the appended claims.

What is claimed is:

1. A rocker switch comprising:

a housing having a cavity defined by opposite, longitudinally extending side walls and a base which mounts a pair of longitudinally spaced apart central and end contacts which each have transversely extending stationary contact surfaces;

a longitudinally extending sliding contact including a central cam portion, and oppositely and upwardly inclined end ramps having transversely extending sliding contact surfaces slidable over and complementally engagable upon the stationary contact surfaces, respectively, the sliding contact also including side portions located adjacent the housing side walls to longitudinally align the sliding contact in the housing cavity, the sliding contact further including a load distribution and pivot means transversely extending between and mounted to the side portions of the sliding contact, the sliding contact being characterized by a first switch position in which the cam portion lies between the central and end contacts, and below the contact surface of the central contact, with the ramps engaged upon the central and end contacts, respectively, and further characterized by a second switch position in which the ramp which engaged the end contact in the first switch position is engaged upon the central contact;

an operator rocker mounted in the housing for pivotal movement about a transverse axis and including an actuable portion located exteriorly of the housing, and further including an elongated shaft portion extending interiorly of the housing and terminating in a lower extremity having an elongated, transversely oriented slot which receives the pivot means for pivotal movement about a transverse axis and for slidable movement in the slot along the longitudinal axis of the elongated shaft portion; and a compression spring carried by the shaft portion of the rocker and bearing against the pivot means to carry the bias of the spring to both side portions of the sliding contact and thereby assure good electrical contact across the full width of the contact surfaces of the end ramps, the actuable portion of the rocker being operable to pivot the rocker shaft portion in opposite directions for sliding the cam portion across the central contact to move the sliding contact between its first and second switch positions, the pivotal and slidable movement of the pivot means relative to the rocker shaft portion enabling free pivoting and raising and lowering of the sliding contact cam portion as it moves across the stationary contact.

2. A rocker switch according to claim 1 in which the sliding contact has a shallow V-shape configuration in longitudinal cross section, with the depressed apex of the V-shape constituting the central cam portion, and the upwardly inclined extremities of the V-shape constituting the end ramps.

3. A rocker switch according to claim 1 in which the bias of the spring is great enough that the necessary compression of the spring for movement of the sliding contact cam portion across the central contact provides a detent action tending to maintain the sliding contact in one of the first and second switch positions.

4. A rocker switch according to claim 1 in which the pivot means comprises an elongated pin having an external diameter approximating the width of the shaft portion slot to constrain the pin against transverse movement relative to the elongated slot.

5. A rocker switch according to claim 1 in which the central contact is reversely formed upon itself to define curvilinear portions for easy slidable engagement by the sliding contact.

* * * * *